United States Patent [19]

Foster, Jr.

[11] Patent Number: 4,627,211

[45] Date of Patent: Dec. 9, 1986

[54] SLED FOR A REINFORCING CAGE USED IN A PIER

[76] Inventor: Thomas W. Foster, Jr., 3901 Shady Valley Dr., Arlington, Tex. 76013

[21] Appl. No.: 778,975

[22] Filed: Sep. 23, 1985

[51] Int. Cl.[4] ..... E04H 12/12; E02D 5/22

[52] U.S. Cl. ..... 52/652; 52/742; 405/239

[58] Field of Search ..... 52/677–689, 52/742, 169.9, 169.14, 646, 650–653; 405/239, 243

[56] References Cited

U.S. PATENT DOCUMENTS

| | | | |
|---|---|---|---|
| 790,230 | 5/1905 | Stempel | 405/231 |
| 1,043,782 | 11/1912 | Lindau | 52/646 |
| 1,708,277 | 4/1929 | Martin | 52/652 |
| 2,612,024 | 9/1952 | Hunsucker | 52/742 |
| 3,257,767 | 6/1966 | Lassy | 52/652 |
| 3,471,986 | 10/1969 | Swenson | 52/652 |
| 3,722,164 | 3/1973 | Schmidgall | 52/652 |

FOREIGN PATENT DOCUMENTS

| | | | |
|---|---|---|---|
| 432788 | 9/1967 | Switzerland | 52/684 |

*Primary Examiner*—James L. Ridgill, Jr.
*Attorney, Agent, or Firm*—Charles W. McHugh

[57] ABSTRACT

A combination support/spacer adapted for attachment to the periphery of a reinforcing cage—prior to the time that the cage is lowered into a pier hole. The support/-spacer is configured in such a way as to be aptly referred to as a sled. The sled has a runner which is adapted to be in contact with the earth surrounding a pier hole, and said runner has a substantial flat face so that it provides wide-area contact with the earth. The runner has two ends, both of which are inclined upwardly with respect to the plane of the runner face. Both ends are turned up by the same amount, so that the sled may be mounted on a reinforcing cage without regard to a particular orientation, and so that the sled will perform equally well if the cage is being lowered or raised in the pier hole.

A longitudinal web extends from one end of the runner to the other end; the web serves to support the runner in its concave configuration, as well as to provide a base for two spaced tabs that are designed to make contact with a longitudinal member of the reinforcing cage. A pair of wings are preferably provided at approximately the mid point of the sled, and the wings extend high enough on the sled to make contact with an adjacent spiral loop when the tabs are in contact with a longitudinal rod. Small holes are provided in both the tabs and the wings so that tie wires may be passed through the holes in order to secure a sled at a desired position on a reinforcing cage. A plurality of such sleds positioned around and along a reinforcing cage will ensure that the cage is held away from the sides of a pier hole by a distance equal to the height of the sleds, both during insertion of the cage and during the pouring of concrete therearound. The sled is preferably made of a material like polypropylene, so that it may be safely imbedded in the resultant concrete pier without any risk of deterioration due to rust or corrosion.

12 Claims, 8 Drawing Figures

PIER HOLE DIAMETER, INCHES

| PIER HOLE DEPTH, FT. | LESS THAN 30 | 30 THRU 48 | 54 THRU 72 |
|---|---|---|---|
| 10 - 14 | 6 | 8 | 12 |
| 16 - 24 | 9 | 12 | 18 |
| 26 - 34 | 12 | 16 | 24 |
| 36 - 44 | 15 | 20 | 30 |
| 46 - 54 | 18 | 24 | 36 |
| 56 - 64 | 21 | 28 | 42 |

RECOMMENDED QTY. OF SLEDS PER REINFORCEING CAGE

*FIG. 8*

SLED FOR A REINFORCING CAGE USED IN A PIER

BACKGROUND OF THE INVENTION

This invention relates generally to spacing devices which are used to support reinforcing materials prior to the time that those materials become imbedded within concrete structures; more particularly, the invention relates to a support which is adapted to be affixed to and move with a reinforcement cage as that cage is lowered into a prior hole—just prior to the time that concrete is poured into the hole.

It is well known to reinforce concrete piers (and other concrete structures) with steel reinforcing rods. And, it is also known to provide spacers in order to hold reinforcing rods or mesh away from the sides of concrete forms. Examples of such spacers of the prior art are shown in the following U.S. Pat. Nos. 790,230 to Stempel entitled "Method of Protecting Piles or the Like"; 1,708,277 to Martin entitled "Device for Positioning the Reinforcement of Concrete Structures"; 3,722,164 to Schmidgall entilted "Spring Wire Spacer, Especially for Spacing Reinforcing Mesh from the Form in the Manufacture of Concrete Structures and the Like"; 3,257,767 to Lassy entitlted "Snap-On Spacer Positioner for Reinforcement"; and 3,471,986 to Swenson entitled "Spacer for Reinforcing Mesh for Concrete Pipe and the Like". A characteristic of all of the spacers that have been identified, however, is that they are only operable within smooth, rigid forms. That is, the wire spacers exemplified by Schmidgall, Swenson and Lassy may well be perfectly suited for use in a form for casting concrete pipe or the like; but the relatively sharp "point" that is intended to bear against a rigid mold or form would be total unsuitable for the raw earth that surrounds a pier hole (or drilled shaft) that is about to be poured full of concrete. The act of lowering a reinforcement cage into a typical pier hole with such sharply pointed spacers could cause the points to act like small plows, digging a groove into the soil and/or knocking clods of dirt down into the hole. An alert inspector who noticed that the bottom of the hole was becoming fouled with loose dirt could demand that the entire cage be withdrawn and the hole cleaned before permitting the pouring of concrete. Of course, the step of removing and then replacing such a cage would likely compound the problem by moving the heavy cage along the sides of the pier hole two more times. Hence, there has long remained a need for a spacing device which could provide for piers the spacing advantages that are available for cast concrete pipe and the like, while not introducing a risk of deterioration of the sidewall of the hole; and it is an object of this invention to provide such a spacer.

It is another object to provide a dynamic guide for a reinforcement cage, so that the cage may be used in situations where soil conditions would make installation of an unprotected cage impractical.

Still another object is to provide a spacer for a steel reinforcing rod in order to ensure that it will eventually be imbedded within concrete, such that ground water and/or corrosive soils will not have a chance to come into contact with the rod and contribute to its corrosion and eventual failure.

One more object is to provide a spacer having sufficient strength as to ensure that a reinforcing cage will remain centered in a pier hole, even when fluid concrete is acting to force that cage to a non-centered position. This and other objects will be apparent from a reading of the specification and the claims appended thereto, with appropriate reference to the drawing provided herewith.

DESCRIPTION OF THE FIGURES OF THE DRAWING

FIG. 8 is a chart showing the recommended quantity of sleds for pier holes having a diameter up to 72 inches and a depth up to 64 feet.

BRIEF DESCRIPTION OF THE INVENTION

In brief, the invention disclosed herein comprises a spacer that is configured in such a way as to be aptly referred to as a sled. The sled has a runner which is adapted to be in contact with the earth which surrounds a pier hole, and said runner has a substantial flat face so that it provides wide-area contact with the earth—thereby minimizing the risk of being pushed deeply into the sides of a hole by any force transmitted by the reinforcing cage. The runner has two ends, both of which are inclined upwardly (or inwardly) with respect to the plane of the face of the runner. Both ends are turned up by the same amount, so that the sled may be mounted on a reinforcing cage without regard to a particular orientation, and so that the sled will perform equally well if the cage is being lowered or raised in the pier hole.

A longitudinal web extends from one end of the runner to the other end; the web serves to support the runner in the desired configuration, as well as providing a base for two spaced tabs that are designed to make contact with a longitudinal member in the reinforcing cage. A pair of wings are preferably provided at approximately the mid point of the sled, and the wings extend high enough on the sled to make contact with an adjacent spiral loop when the tabs are in contact with a longitudinal rod. Small holes are provided in both the tabs and the wings so that tie wires may be passed through the holes in order to secure a sled at a desired position on a reinforcing cage. A plurality of such sleds appropriately positioned around and along a given reinforcing cage will ensure that the cage is held away from the sides of a pier hole by the appropriate distance, both during insertion of the cage and during the pouring of concrete therearound. The sled is preferably made of a thermoplastic material like polypropylene, so that it may be safely imbedded in the resultant concrete pier without any risk of deterioration due to rust or corrosion.

DETAILED DESCRIPTION OF THE PREFERRED EMBODIMENT

Figure 1:
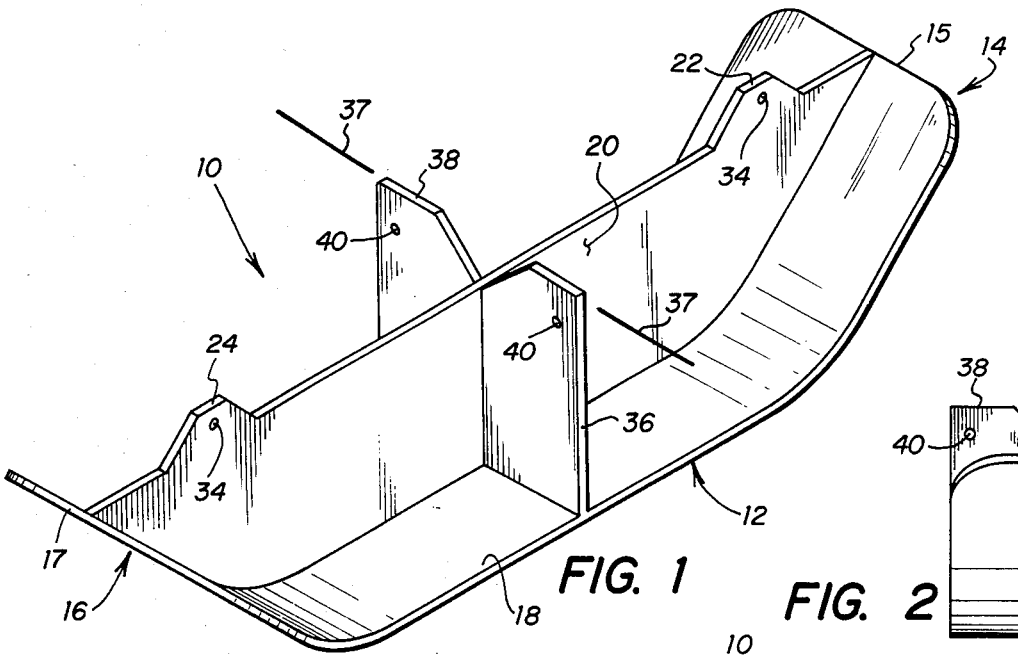
FIG. 1 is a perspective view of one embodiment of the invention, wherein the two transverse wings are centrally positioned in the same plane.
Figure 3:
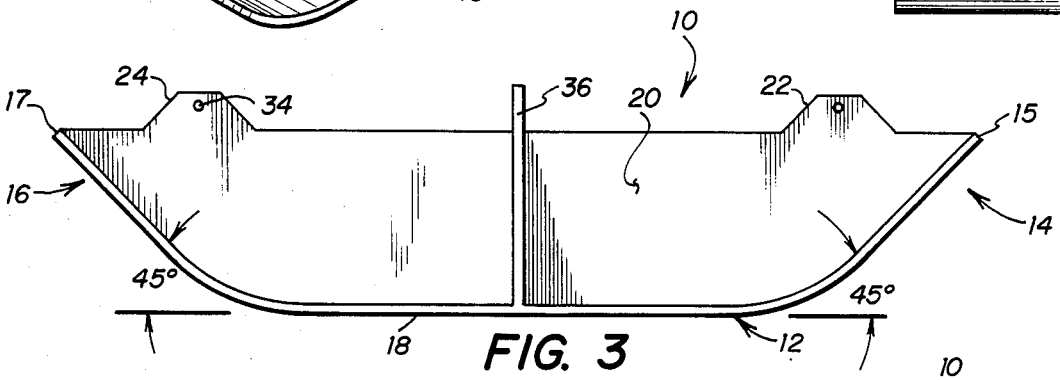
FIG. 3 is a side elevational view of the embodiment shown in FIG. 1.

Referring initially to FIG. 1, an article of manufacture in accordance with this invention constitutes a device 10 which functions as both a mobile support and a static spacer—which is adapted for positioning a reinforcing cage with respect to a pier hole. Because of the appearance of the preferred embodiment, and because of its utility in supporting a cage during dynamic conditions, the device may be aptly referred to as a sled. The sled includes a non-planar runner 12 which has a first end 14 and a second end 16, and a substantially smooth plate 18 between the first and second ends. The two ends 14, 16 are inclined in the same direction away from the plane of the plate 18, so as to form a generally concave shape as seen in an elevational view like FIG. 3. In the preferred embodiment, both end portions are inclined upwardly with respect to the plate by about 45 degrees, such that the included angle between the two ends of the runner is about 90 degrees.

The plate area will determine to a significant extent exactly how efficient a given sled will be in supporting its associated reinforcing cage, and it is believed that the plate should have a minimum area of 18 square inches. Of course, it is this plate area that can be expected to contact the earth in a pier hole, so a slightly larger area, i.e., 24 square inches, is a particularly good size for the plate. There is a practical limit to the plate size, of course, because the sled must not unduly interfere with the reinforcing cage while it is being manipulated into a pier hole; nor may the sled be so large as to interfere with the structural integrity of the concrete pier that is to be fabricated. Hence, it is believed that the width of a runner should be no more than about four inches, and a three inch width is preferred. By limiting the size of a sled to an easily manageable and convenient size, and distributing several small sleds at spaced locations around the reinforcing cage, the sleds themselves should introduce no adverse effect on a pier that is at least twelve inches in diameter and has been properly poured (so that there are no voids created around a sled during the pouring of concrete).

A web 20 extends longitudinally of the runner 12 and is affixed to the runner so as to reinforce it and to hold it in its generally concave shape. Ideally the web 20 extends from the edge 15 of first end 14 to the edge 17 of second end 16; and to further contribute strength to the sled 10, the web and the runner are preferably integrally formed—from a molded plastic such as high-density polypropylene or polyethylene, etc. Such plastics having a tensile strength of at least 4,000 psi offer adequate strength at reasonable cost, and are also advantageous in that they do not rust. The concern for rusting or other deterioration is of great importance, of course, because moisture in the ground would eventually lead to the deterioration of an iron spacer that is characteristic of the prior art, which would in turn lead to corrosion and/or failure of a reinforcing rod buried within a pier. Resistance to moisture as well as immunity to attack by chemicals that occur naturally or otherwise, plus resistance to tearing, make high-density polypropylene the material of choice. A preferred material is TENITE polypropylene 4240 supplied by Eastman Chemical Products, Inc. or Norchem 8004 MR supplied by Northern Petrochemical Company.

Associated with the web 20 are two tabs 22, 24, which consistute a means for bearing against a given one of the longitudinal reinforcing rods in a reinforcing cage. The relative position of these tabs 22, 24 and a longitudinal reinforcing rod can be perhaps best understood by referring next to FIG. 6, wherein a typical reinforcing cage 26 has longitudinal rods 28A, B and C, and a spiral rod 30. The tabs 22, 24 are typically placed next to a longitudinal rod 28 and held in place by short pieces of the wire 32. Tie wire is routinely utilized in fabricating reinforcing cages, and forms no part of the present invention; however, it is important that a tab be constructed so that a tie wire does not tear through a tab. To more nearly ensure that there will be adequate material to resist any such tearing, it is preferred that the apertures 34 in tabs 22, 24 have a diameter of about 3/32 inch and be located so that they are at least ⅜ inch away from the top edge of a tab.

Figure 2:
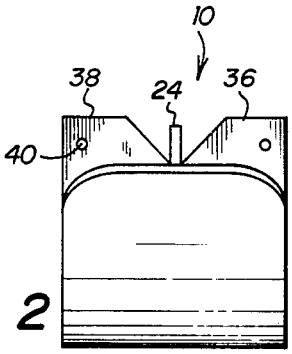
FIG. 2 is an end elevational view of the embodiment shown in FIG. 1.
Figure 4:
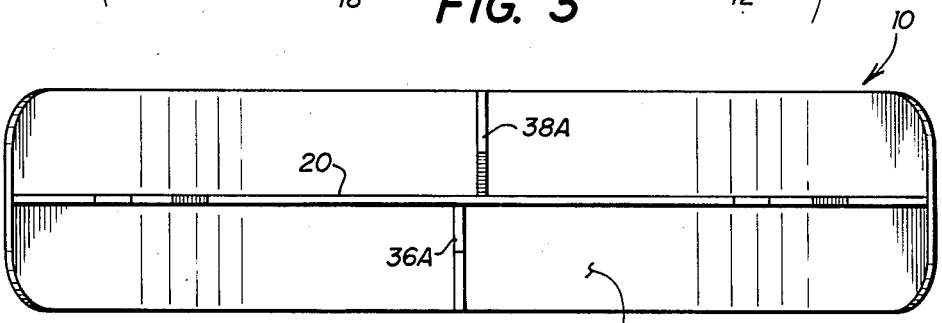
FIG. 4 is a top plan view of an alternate embodiment of the invention in which the two wings are integrally formed with the runner and web, but are offset with respect to the center of the sled.
Figure 5:
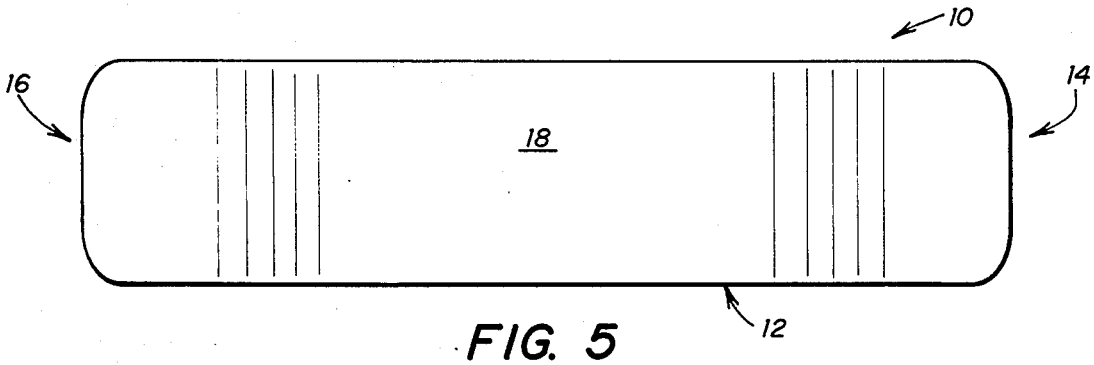
FIG. 5 is a bottom plan view of a sled, showing the substantial rectangular area which is adapted to make contact with the sides of a pier hole.
Figure 7:
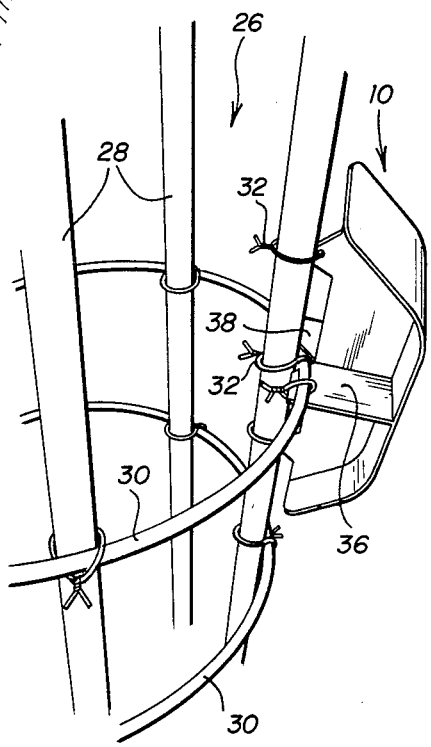
FIG. 7 is a perspective view of an exemplary sled after it has been attached with tie wires to both a longitudinal rod and a spiral rod.

Another element of the sled 10 constitutes a means for assisting both the positioning and orientation of the web 20 at a desired location alongside the reinforcing cage 26. A preferred form for this particular feature includes a pair of elements which extend outwardly from the web such that they lie transversely of the sled, preferably near the center thereof and perpendicularly to the web. These elements 36, 38 lie in the transverse plane identified by line 37 in FIG. 1. Because they are relatively thin (in order to conserve material) and they are relatively flat (in order to foster convenience in manufacturing), they may be casually referred to as wings or wing-like elements. As can perhaps best be seen in FIGS. 2 and 3, the tops of the wings 36, 38 are at least as high as the plane defined by the tops of tabs 22, 24; but this configuration is not exactly critical, because the tops of the wings are not designed to bear against any particular structure (as are the tops of tabs 22, 24). Hence, the configuration and height of the wings may be adjusted somewhat—except for the central portion of the combined wings. As is perhaps best visible in FIG. 7, the two wings 36, 38 are adapted to be secured to the spiral rod 30 of a typical reinforcing cage. And to that end, apertures 40 having a size (e.g., 3/32 inch) to easily accommodate tie wires are provided near the outer edges of the respective wings. By providing on the two wings 36, 38 an upper edge (which is higher at remote points than at its proximal points—as measured from the web), the top of the wing-like elements may be described as having a V-shaped configuration. The lowest part of the "V" is then ideally suited to nest with the spiral rod 30; and, because of the inclined orientation of the spiral rod 30, one wing-like element 36 may rest above the spiral rod while the other element 38 rests below said rod. If the inclination of the spiral rod 30 is relatively slight, it may be advantageous to have at least some flexibility in the material of the wings 36, 38—so that they may be slightly bent in order to conform to the position of an adjacent spiral rod without interfering with alignment of the web with its associated longitudinal rod 28. Alternatively, the two wings may be slightly offset with respect to the center of the sled 10, so that the need to bend the wings during installation will be reduced or eliminated; this embodiment is illustrated in FIG. 4, where wing 36A is offset with respect to wing 38A. It will also be apparent from FIG. 4 that the preferred plate area is rectangular.

From a structural point of view, it should be apparent that the apertures 34 in tabs 22, 24 constitute a means for permitting connection of the web 20 to the longitudinal members of a reinforcing cage; thus, apertures 34 contribute to longitudinal stability of the sled with respect to the reinforcing cage, especially when the tabs are adequately spaced. Spacing the tabs about eight inches apart has been found to be a good design, because—for one reason—it allows a great deal of choice in where to locate a sled with respect to a spiral rod 30. The apertures 40 also permit connection of the web 20 (through the wings 36, 38) to the reinforcing cage, these apertures contribute to what will be called rotational stability of the sled. That is, when common tie wires have been passed through the apertures 40 and wrapped around a longitudinal rod 28 and/or a spiral rod 30, the sled 10 will be restrained against rotating (or rolling) with respect to the cage as the cage is lowered in a pier hole.

Another feature about the sled which is not susceptible of being illustrated is the sliding characteristics of the sled when it is being moved with respect to the earth of a pier hole. It is preferred that the material from which the runner is made have a coefficient of sliding or kinetic friction (with respect to damp earth) of no greater than about 0.2. This will help ensure that the material (earth, rock, sand, etc.) forming the sides of a pier hole will not impose such a dragging force on the sled that such material will be pulled loose, with the result that the material would fall to the bottom of the pier hole. By providing runner ends that are curved upwardly (away from the plane of the plate) and making the runner from low-friction material, the sleds and their attached cage will more surely drop into a pier hole without disturbing any of the adjacent wall material.

Attachment of a sled 10 to a cage may be accomplished in a remote fabricating shop or at a job site—with the cage lying horizontally on the ground. (The quantity of sleds 10 that will likely be needed to ensure proper position of a cage within a pier hole is given in the chart of FIG. 8.) A worker will typically choose one of the longitudinal rods 28 that is not at that time bearing directly on the ground and place a sled 10 so that the tabs 22, 24 are pressed directly against the surface of the rod; the web 20 will be oriented such that it is in a plane that passes through the longitudinal axis of the rod 30. The height of the tabs and the wings 36, 38 (slightly more than three inches) ensures that the bottom of the plate 18 will be at least three inches from the rod 28; and when concrete is poured around the sled, there will be a three inch cover of hard concrete over the reinforcing cage.

After affixing one or more sleds 10 to a given longitudinal rod 28 (and the adjacent spiral rod 30), other exposed rods would have sleds attached thereto in a similar manner. There is no need to temporarily lift a reinforcing cage in order to place one or more sleds on the bottom side of the cage, because there will always to enough exposed rods 28, 30 to permit an adequate spread of sleds around the periphery of the cage. Furthermore, the sleds 10 are not intended to ever support the full weight of a reinforcing cage; the sleds are only intended to experience (and resist) sideward loads as a suspended cage is being lowered into a pier hole.

While a single sled 10 can accomplish its function as a combined mobile support and a static spacer, it should be obvious that several sleds must be attached to the periphery of a reinforcing cage in order to reliably maintain the cage in the center of a deep pier hole. For cages of less than 30 inches in diameter, six sleds will probably be adequate for cage lengths up to 14 feet. Those six sleds would be distributed circumferentially around the cage, preferably with three sleds concentrated in the region of the top and three concentrated in the region of the bottom. The three top sleds 10 will typically be located about two feed below ground level, while the bottom three sleds are best placed about three feed from the bottom of the hole; the extra foot of distance from the bottom will help ensure that the sleds bear against the walls of the pier hole, even if the bottom of the hole has been enlarged to provide a bell-shaped "foot" for the pier. Such a bell-shaped "foot" is defined on its lower surface by the transverse plane designated by the numeral 50 in FIG. 6. For other sizes of piers, the preferred number of sleds per reinforcing cage is shown in FIG. 8. The chart is based upon providing, at each "row" or grouping of sleds, the following quantities: for narrow cages (up to 30 inches in diameter), three sleds; for medium cages (30 inches to 48 inches), four sleds; for large cages (54 inches to 72 inches), six sleds. Examining next the length of a cage, it is believed that there should be a circumferential grouping or "row") of sleds about every five to eight feet of cage length, with a smaller ratio naturally being preferred when the reinforcing rods are relatively large. For a pier hole having a size outside the range of values shown in FIG. 8, those skilled in the art will surely to able to extrapolate so as to determine an appropriate quantity of sleds.

Figure 6:
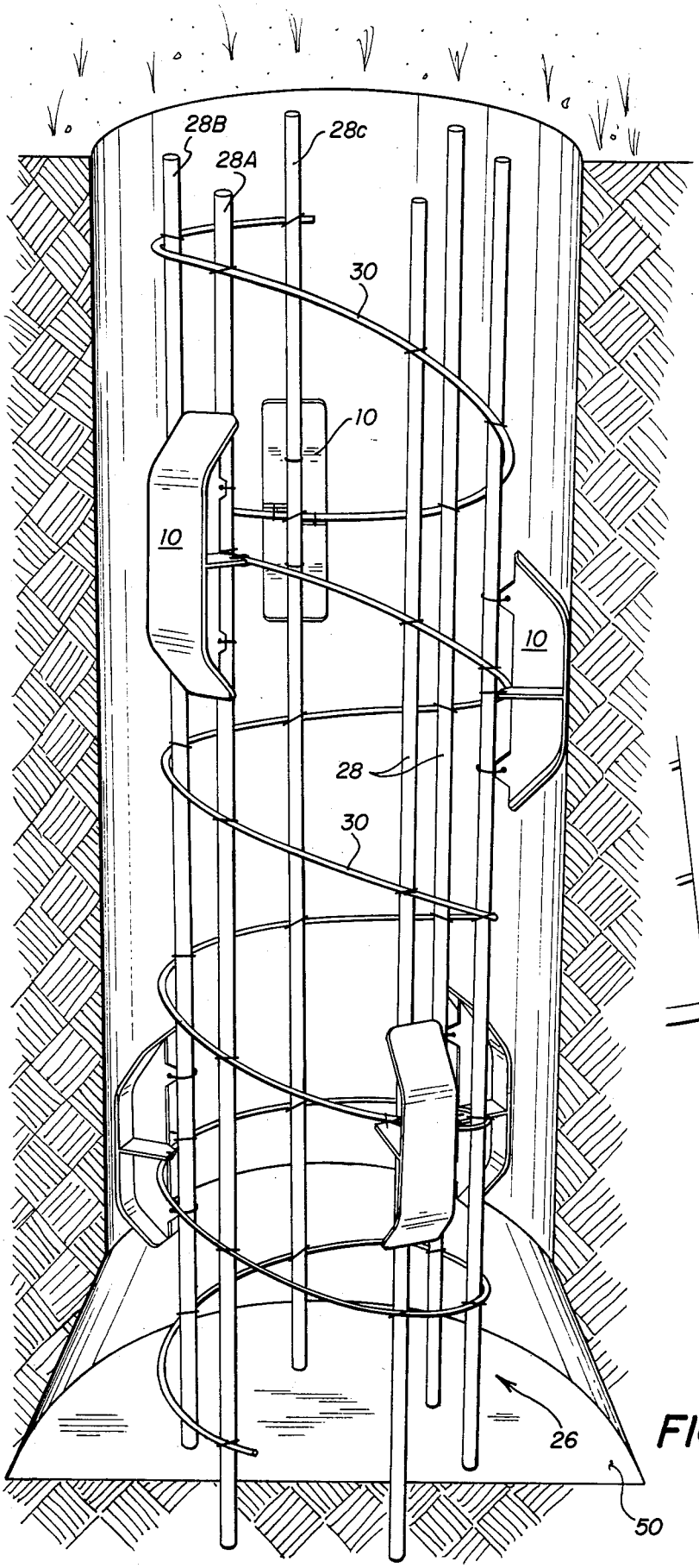
FIG. 6 is a perspective view of an exemplary reinforcing cage shown in a cross-sectioned pier hole, with six exemplary sleds helping to ensure that the reinforcing cage remains centered in the pier hole.

In use, the sled 10 is able to foster the descent of a reinforcing cage in exactly the center of a pier hole, as the cage is supported at one end by a crane or the like and gradually lowered to the position shown in FIG. 6. Of course, the goal of centering a reinforcing cage in a pier hole is quite old; and essentially all specifications for cast-in-place concrete piers usually state that reinforcing materials should be centered. In the prior art, however, the process of centering the reinforcing cage within a pier hole seems to have been left to the personal skill of workers at a job site.

During the act of lowering a reinforcing cage into a pier hole, there will usually be a crew of at least two persons; one of these will be standing on the ground immediately next to the pier hole, and the other person will typically be sitting at some remote location, operating a piece of mechanized equipment such as a crane. If these two people work together efficiently, with the man on the ground giving meaningful signals and the equipment operator responding to them accurately, it might be possible to lower even a 50-foot section of reinforcing cage perfectly straight into a pier hole without causing a peripheral sled to even touch the sides of the hole. In practice, however, this ideal lowering of a cage—which may weigh 2,000 pounds or more—is almost never achieved; and it is very common for the cage to rub against a side of the hole as it is being lowered. While the entire weight of the cage is not expected to ever be applied to one or more sleds, prudence dictates that the sleds be evaluated for possible failure as a result of the application of too much force. A failure analysis of a preferred form of the invention, wherein the total length of a polypropylene sled (from edge 15 to edge 17) is 12½ inches, the width of the runner is 3 inches, and the thickness of the web is ⅛ inch, reveals that each sled can be expected to support a load in excess of 150 pounds before the sled might fail in compression. The configuration of the tabs 22, 24 of course helps prevent compressive failure, because any possible deformation of the top-most portion causes the load to be immediately distributed to a wider, lower portion Hence, the trapezoidal shape of the tabs is a preferred configuration, with the longer leg of the trapezoid being the "bottom" leg.

It is standard operating procedure to pour concrete into a pier hole very shortly after a reinforcing cage has been installed. Observing this practice helps guard against any damage to the hole that might contribute to a loss of strength in the resultant pier. So, if some unforseen delay should prevent the pouring of concrete within a reasonable time after a reinforcing cage was installed, many architects would demand that the reinforcing cage be removed and the hole be reinspected before concrete is poured. That is, no one would expect a work crew to install a reinforcing cage on Friday afternoon but not pour concrete until the following Monday morning—without first inspecting the hole to ensure that the sides of the hole haven't dried out and sloughed off, and that no extraneous material has fallen into the hole, etc. With the sleds of this invention having their two ends essentially symmetrical with respect to the center of the sled, the sleds will tend to be equally effective in supporting the cage and maintaining a proper spatial relationship with the pier hole—regardless of which direction a cage is being moved with respect to the hole, i.e., in or out. And, of course, the substantially rectangular and smooth plate 18 is equally effective when a cage is being put into a pier hole or being removed therefrom.

After a longitudinally supported reinforcing cage has been successfully lowered into a pier hole, the dynamic sleds 10 then function as static spacers—to hold the cage in the center of the hole as concrete is being poured around it. And while it should perhaps be apparent from an examination of the figures of the drawing, there is nothing in the design of a sled that would interfere with either the positioning of a tremie within the cage or the flow of wet concrete around the cage. The tie wires that are used to affix a plurality of sleds to the periphery of a cage will protrude no further into the center of a cage than would other tie wires that are used to secure the spiral rod 30 to the several longitudinal rods 28. And there is nothing on the sled that would serve as an obstacle to the efficient flow of wet concrete, etc., especially when a low-fiction ($\mu=0.2$) polypropylene resin is used to mold the smooth sleds as integral units.

While only two of the preferred embodiments of the invention have been disclosed herein in great detail, it should be apparent to those skilled in the art that certain variations in proportions and sizes, etc., could be made without departing from the spirit of the invention. For example, the distance from the bottom of the plate 18 to the top of the tabs 22, 24 has been established as three inches. This distance has been selected in order to meet a frequently encountered requirement for cast-in-place concrete piers that there be a minimum cover of three inches of concrete outside the envelope defined by the reinforcing cage. In other words, the three inch height of the sled 10 will guarantee that longitudinal reinforcing rods will never come closer to the side walls of a pier hole than the height of a properly installed sled. However, if the specification for some particular concrete pier should require four inches of concrete "cover", then such a requirement could easily be met by making the web taller. Also, the ⅛ inch thickness of the web, runner and wings could be increased so as to make the sled stronger, if a stronger sled should be needed or desired in order to meet some special conditions. Those skilled in the art will no doubt recognize other ways in which the preferred form of the invention might be slightly altered in order to accomodate special circumstances. It follows, therefore, that the scope of this invention should be measured only by the claims which are appended hereto.

What is claimed is;

1. A combination mobile support and static spacer adapted for positioning a reinforcing cage with respect to an earthen pier hole in both static and dynamic conditions, comprising:

(a) a runner having first and second ends and a substantially smooth plate therebetween, and the two ends being inclined in the same direction away from the plate so as to form a generally concave shape, and the plate having an area of at least 18 square inches for contacting the earth in the pier hole;

(b) a web extending longitudinally of the runner and affixed thereto so as to reinforce the runner and to hold the same in a generally concave shape;

(c) means associated with the web for bearing against a given one of the longitudinal reinforcing rods in a reinforcing cage; and (d) means including a pair of wing elements which extend transversely of the web for positioning and orienting the web at a desired location alongside the reinforcing cage, and including means for permitting a tie-wiring connection of the wing elements to members of the reinforcing cage.

2. The combination support/spacer as claimed in claim 1 wherein the two ends of the runner are inclined away from the substantially smooth plate for a distance that is sufficient to cause said two ends to lie approximately in the plane of the top of the web.

3. The combination support/spacer as claimed in claim 1 wherein the height of the web is approximately three inches.

4. The combination support/spacer as claimed in claim 1, wherein the two wing elements are centrally located with respect to the web, and the combined width of the two wing elements is about three inches.

5. The combination support/spacer as claimed in claim 1 wherein the two wing elements are formed of slightly flexible material such that they may be slightly bent in order to conform to the position of an adjacent spiral rod without interfering with alignment of the web with a longitudinal rod of the reinforcing cage.

6. The combination support/spacer as claimed in claim 1 wherein the two wing elements have an upper edge which is higher at points that are remote from the web than are points immediately adjacent the web, such that the top of the wing elements may be described as having a V-shaped configuration.

7. The combination support/spacer as claimed in claim 1 wherein the two ends of the runner have an included angle of about 90° between them, and the angle formed between each end and the substantially smooth plate is about 45°, whereby the support/spacer tends to be equally effective regardless of the direction in which a reinforcing cage is being moved with respect to a pier hole.

8. The combination support/spacer as claimed in claim 1 wherein the smooth plate is substantially rectangular.

9. The combination support/spacer as claimed in claim 1 wherein the bottom of the substantially smooth plate has a coefficient of sliding friction ($\frac{3}{4}$) with respect to damp earth of no greater than about 0.2.

10. The method of placing a steel reinforcing cage into an earthen pier hole in such a way as to foster preservation of the integrity of the sides of the pier hole, comprising the steps of:

(a) affixing with tie wires a plurality of small thermoplastic sleds having runners to the periphery of a reinforcing cage before said cage is lowered into the pier hole, and each of said sleds having a runner which is oriented to face outwardly toward the sides of the pier hole, and the sleds also being distributed circumferentially and longitudinally around the cage in a manner designed to encompass the periphery of the cage, and providing a wide area of contact between each runner and the pier hole, thus fostering gentle passage of the cage along the sides of the pier hole as the cage is lowered into said hole;

(b) supporting the reinforcing cage by one end over the pier hole and then lowering the cage into the hole, so that the sleds act to maintain the descending cage in the center of the hole; and (c) subsequently pouring concrete around the reinforcing cage and the attached sleds, so that the sleds become imbedded in the resulting pier without creating a potential corrosion path between the earth and the steel reinforcing cage.

11. The method as claimed in claim 10 wherein the sleds are symmetrical with respect to a central plane passing transversely through the sleds, and including the step of affixing the sleds to the reinforcing cage so that their longitudinal axes are parallel to the longitudinal axis of the reinforcing cage, thus making the sleds effective at fostering the controlled movement of a reinforcing cage when the cage is being lowered into a pier hole and making the sleds equally effective if the cage must be subsequently pulled out of the pier hole prior to the pouring of concrete.

12. The method as claimed in claim 10 wherein the sleds are symmetrical with respect to a central plane passing transversely through the sleds, and including the step of affixing the sleds to the periphery of the reinforcing cage with an orientation in which the central transverse plane of a sled is parallel to a transverse plane through the reinforcing cage, such that the sleds are equally effective in fostering downward movement of a cage into a pier hole, regardless of which end of a sled is pointed downward during the affixation step, whereby the sleds may be affixed to the cage by unskilled labor at a site immediately adjacent the earthen pier hole without running the risk of having a given sled installed upside down.

* * * * *